US007509952B2

(12) United States Patent
Aiken, III et al.

(10) Patent No.: US 7,509,952 B2
(45) Date of Patent: Mar. 31, 2009

(54) PAINT BALL POCKET FOR SLINGSHOTS

(76) Inventors: Harry L. Aiken, III, 5616 S. Craig Rd., Medical Lake, WA (US) 99220; James H. Johnston, 4144 E. 26th, Spokane, WA (US) 99223

( * ) Notice: Subject to any disclaimer, the term of this patent is extended or adjusted under 35 U.S.C. 154(b) by 342 days.

(21) Appl. No.: 11/588,054

(22) Filed: Oct. 27, 2006

(65) Prior Publication Data

US 2008/0099003 A1 May 1, 2008

(51) Int. Cl.
*F41B 3/02* (2006.01)

(52) U.S. Cl. ..... 124/20.1; 124/41.1

(58) Field of Classification Search ..... 124/20.1, 124/20.2, 20.3, 41.1, 80
See application file for complete search history.

(56) References Cited

U.S. PATENT DOCUMENTS 1,932,943 A * 10/1933 Smith ..... 446/247
2,823,483 A * 2/1958 Malott ..... 43/19
2,825,323 A * 3/1958 Huszar ..... 124/20.1
D187,636 S * 4/1960 Nagel ..... D6/547
3,365,761 A * 1/1968 Kalvig ..... 248/113
3,401,867 A * 9/1968 Long et al. ..... 55/361
4,274,387 A * 6/1981 McBride ..... 124/20.2
D374,265 S * 10/1996 Rasmussen ..... D22/107
5,657,984 A * 8/1997 Leo ..... 124/20.1
6,161,263 A * 12/2000 Anderson ..... 24/545
6,564,787 B1 * 5/2003 Barry ..... 124/20.1
6,712,060 B2 * 3/2004 Egusquiza ..... 124/91
7,389,774 B1 * 6/2008 Fonda ..... 124/20.1

* cited by examiner

*Primary Examiner*—John Ricci
(74) *Attorney, Agent, or Firm*—Bergman & Jeckle PLLC

(57) ABSTRACT

A paintball pocket for a crotch type slingshot, having a pocket strap with opposing elongate end portions, each end portion defining a hole to releasably interconnect with an elastomeric draw strap communicating with the slingshot. The pocket strap having a paintball cavity defined by four tear stop holes and two intersecting through cuts that create four adjacent triangular flaps that bend rearwardly to frictionally engage with a circumferential surface of a spherical paintball, the cavity having a diameter approximately equal to the diameter of the paintball. A pocket handle having a horizontal loop and a vertical loop, each loop having strap connecting ends stitched to the pocket strap adjacent opposing triangular flaps, and a gripping portion wound circumferentially with thread forming a tapered funnel structure adjacent rearward the pocket strap and the paintball cavity that limits rearward movement of the paintball into the paintball cavity.

6 Claims, 3 Drawing Sheets

PAINT BALL POCKET FOR SLINGSHOTS

II. BACKGROUND OF INVENTION

IIA. RELATED APPLICATIONS

There are no applications related hereto heretofore filed in this or in any foreign country.

IIB. FIELD OF INVENTION

This invention relates to mechanical guns and projectors, and more particularly to crotch type slingshots having a handle, an ammunition pocket and elastic bands for propelling projectiles.

IIC. BACKGROUND AND DESCRIPTION OF PRIOR ART

Slingshots have been known for many years and are a nostalgic childhood toy for propelling small rocks and the like at targets and such. A slingshot typically provides a sturdy "Y" shaped frame having a handle that branches at a top portion into two upwardly and outwardly projecting arms. Elastomeric straps interconnect the arms with an ammunition pocket that is commonly a strap of flexible material such as leather.

To shoot the slingshot an operator holds the handle of the "Y" shaped frame in one hand. The operator places a projectile in the ammunition pocket with his second hand. The ammunition pocket and projectile carried therein are firmly squeezed between the fingers of the second hand. The operator extends the arm and hand carrying the handle away from his body and draws the ammunition pocket rearwardly with his second hand, stretching the elastomeric straps. After aiming, the ammunition pocket is released. The retracting elastomeric straps propel the ammunition pocket and the projectile forwardly through the space defined between the two arms. The inertia generated by the retracting elastomeric straps carries the projectile toward the target.

The popularity of slingshots has diminished as the sport of paintball shooting has emerged. "Paintballing", as the sport of paintball shooting is commonly called, involves firearm-like guns that use pressurized gas (typically CO2) to fire small plastic spheres filled with fluidic paint (paint balls) at targets and such. The paint balls rupture, and release the fluidic contents, when they are subjected to compressive forces, such as the forces generated upon striking a target. The paint provides evidence of a target strike.

Paint ball guns are similar in operation and in appearance to firearms. Paintball guns commonly have a stock supporting a barrel, a trigger mechanism incorporated into the stock, an ammunition magazine and a loading mechanism that moves paint balls from the magazine into a chamber communicating with the barrel. Responsive to pulling the trigger, a burst of pressurized gas is released into the chamber which forces the paintball outwardly through the barrel at relatively high velocities.

Paintballing is not an activity for everyone. Many paintballing clubs and organizations prohibit persons under a certain age from participating in paintball tournaments, combat courses, capture the flag games, and even target shooting where prizes are awarded. The limitations imposed on the firing of paint balls with paintball guns are generally not imposed upon the firing of paint balls with slingshots.

Firing paint balls with slingshots has been previously attempted in an effort to capitalize on the positive aspects of both slingshots and paintballing, namely availability to those persons who do not have access to firearms, competitive organized games and events, and reduced risk of serious injury due to lower projectile velocities and the semi soft nature of paintballs. Unfortunately, prior efforts have proven unsuccessful because paintballs break when they are squeezed between the operator's fingers as the ammunition pocket carrying a paintball is drawn rearwardly to extend the elastomeric straps. Further, paint balls fall out of the ammunition pocket unless they are continuously held in place. The only way to prevent paintballs from falling out of the ammunition pocket is for the operator to continuously hold the paintball in place, or to only place the paintball in the ammunition pocket when the operator is ready to fire. These limitations reduce the appeal and effectiveness of slingshots to fire paint balls in paintball competitions because mobility and the ability to fire quickly are critical elements of such competitions.

The instant invention seeks to overcome these and other drawbacks to apparatus for firing paintballs from slingshots by providing a paintball pocket for a slingshot that may be drawn rearwardly for firing without squeezing the pocket and paintball contained therein possibly rupturing the paintball, and a paintball pocket for a slingshot that positionally maintains a paintball in the ammunition pocket, ready for drawing and firing without the need for continuous operator supplied pressure.

Our invention does not reside in any of the foregoing features individually but rather in the synergistic combination of all of its structures, which necessarily give rise to the functions flowing therefrom as herein specified and claimed.

IID. SUMMARY

A paintball pocket for a crotch type slingshot having a frame with two spaced upwardly and outwardly projecting arms provides a suede leather pocket strap having opposing elongate end portions, opposing top and bottom edges, a front face, a back face, and defines a draw strap fastening hole in each elongate end portion. Elastomeric draw straps communicate between each draw strap fastening hole and each arm of the sling shot frame. A paintball cavity is defined in a medial portion of the pocket strap by four equally spaced rectilinear arrayed tear stop holes and by two intersecting through cuts between the angularly opposed tear stop holes forming four adjacent triangular flaps that bend rearwardly. A paintball pocket handle having a horizontal and vertical loop of cord, each loop having two pocket strap connecting ends each strap connecting end stitched to the back face of the pocket strap spacedly adjacent a triangular flap, and a folded over gripping portion wound circumferentially with thread forming a draw handle spacedly adjacent rearward the paintball cavity.

In providing such an apparatus it is:

a principle object to provide a paintball pocket for a slingshot that allows a paintball to be fired from a slingshot.

a further object is to provide a paintball pocket for a slingshot that may be drawn rearwardly without squeezing the paintball carried within the pocket.

a further object is to provide a paintball pocket for a slingshot that has a pocket handle rearward of the pocket.

a further object is to provide a paintball pocket for a slingshot that positionally maintains a paintball in the paintball pocket without continuous operator supplied pressure.

a still further object is to provide a paintball pocket for a slingshot that is of new and novel design, of rugged and durable nature, of simple and economic manufacture and use and one that is otherwise well suited to the uses and purposes for which it is intended.

Other and further objects of my invention will appear from the following specification and accompanying drawings which form a part hereof. In carrying out the objects of our invention it is to be understood that its features are susceptible to change in design and structural arrangement with only one preferred and practical embodiment of the best known mode being illustrated in the accompanying drawings and specified, as is required.

VI. BRIEF DESCRIPTIONS OF DRAWINGS

In the accompanying drawings which form a part hereof and wherein like numbers of references refer to similar parts throughout:

V. DESCRIPTION OF PREFERRED EMBODIMENT

As used herein, the term "forward", its derivatives, and grammatical equivalents refers to the portion of a paintball pocket that is closest to a slingshot frame when the paintball pocket is drawn for firing. The term "rearward", its derivatives, and grammatical equivalents refers to the portion of the paintball pocket that is furthest from the slingshot frame when the paintball pocket is drawn for firing. The term "outer", its derivatives, and grammatical equivalents refers to a left side portion and a right side portion of the paintball pocket as opposed to a laterally medial portion of the paintball pocket.

Figure 7:
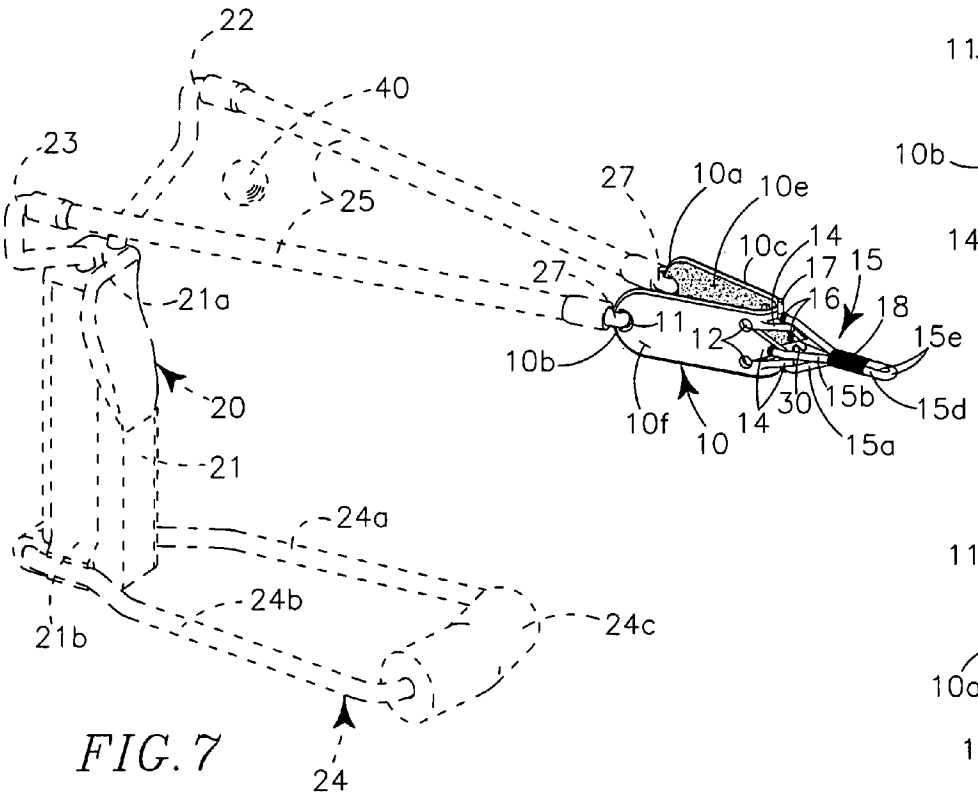
FIG. 7 is an isometric top and left side view of the instant paintball pocket interconnected to a crotch type slingshot with elastomeric straps extending therebetween.

Referring to the drawings, and more particularly to FIG. 7, our paintball pocket for slingshots is designed for use with a crotch type slingshot 20 having a handle 21 that branches, at an upper end portion 21*a*, into first and second spaced upwardly and outwardly projecting arms 22, 23 respectively. Elastomeric draw straps 25, preferably formed of surgical tubing, are fixedly attached to the first and second arms 22, 23 opposite the handle 21 and communicate with draw strap fasteners 27 that are releasably connected to a paintball pocket 10. An arm brace 24 having two rearwardly extending spaced legs 24*a*, 24*b* and an arm pad 24*c* opposite the handle 21 may be carried at a lower end portion 21*b* of the handle 21 to counteract leverage forces generated by stretching the elastomeric straps 25 rearwardly when the slingshot 20 is drawn for firing.

Figure 2:
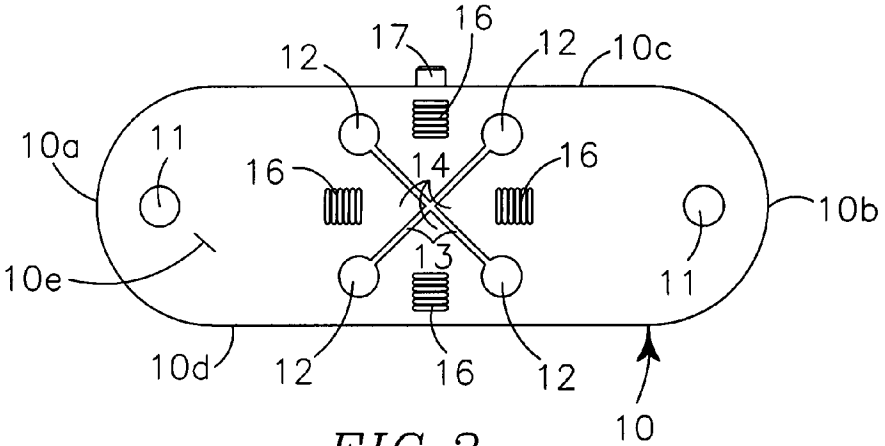
FIG. 2 is an orthographic front view of the paintball pocket of FIG. 1.
Figure 1:
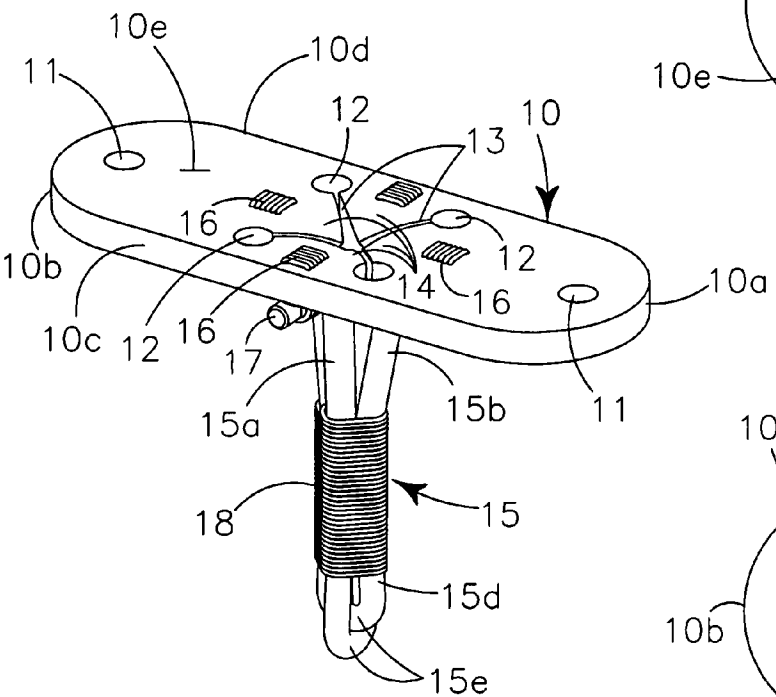
FIG. 1 is an isometric front and top view of our paintball pocket for a slingshot.

Referring now to FIGS. 1 and 2, our paintball pocket for slingshots generally comprises a pocket strap 10 having a first elongate end portion 10*a*, a second elongate end portion 10*b*, a top edge 10*c*, a bottom edge 10*d*, a front face 10*e* and a back face 10*f*. The pocket strap 10 is preferably formed of suede leather that is supple and has a rough unfinished front face 10*e* that accentuates surface friction. Draw strap fastening holes 11 are defined in each elongate end portion 10*a*, 10*b* and carry the draw strap connectors 27 carried by the elastomeric draw straps 25 opposite the arms 22, 23. (FIG. 7).

Figure 9:
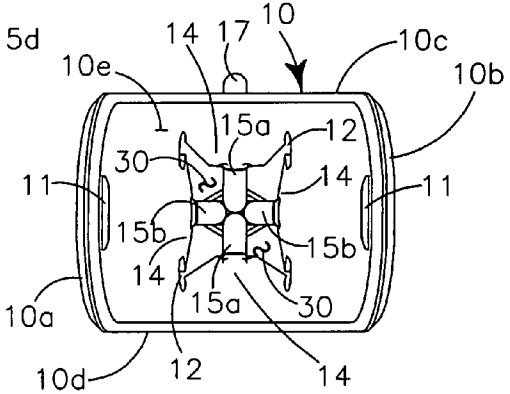
FIG. 9 is an orthographic front view of the paintball pocket of FIG. 8.

A paintball cavity 30 (FIGS. 7 and 9) is defined in the pocket strap 10 by four equally spaced rectilinear arrayed tear stop holes 12 and by two through cuts 13 that extend angularly from each upper tear stop hole 12 to the opposing lower tear stop hole 12. (FIG. 2) The through cuts 13 are perpendicular to one another and intersect one another medially forming four similar triangular flaps 14. Each triangular flap 14 has a base portion (not shown) formed by an imaginary line extending between two immediately adjacent tear stop holes 12, and an apex (not shown) adjacent the intersection of the two through cuts 13. Each triangular flap 14 folds rearwardly approximately along the imaginary line forming the base portion (not shown) when a paintball 40 is in the paintball cavity 30. The precise location of the rearward bend and the line on which the bend occurs cannot be accurately predicted due to the varying nature of the leather which is influenced by characteristics such as grain, age, moisture content, and the like. It is essential the vertical and horizontal spacing between the adjacent tear stop holes 12 is equal so that the bases (not shown) of the four triangular flaps 14 form a square. (FIG. 2). The equal sizing minimizes the contact area between each triangular flap 14 and the spherical paintball 40 which responsively reduces friction and eases release of the paintball 40 from the paintball cavity 30 when the slingshot 20 is fired.

Figure 3:
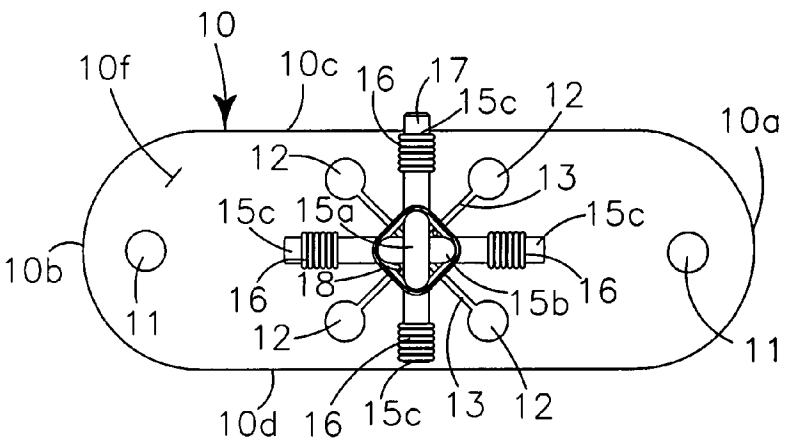
FIG. 3 is an orthographic back view of the paintball pocket of FIG. 1.
Figure 5:
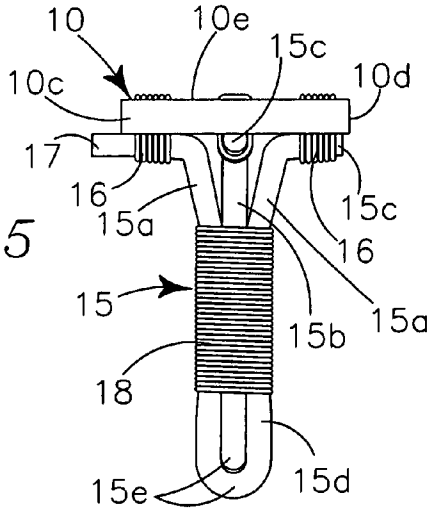
FIG. 5 is an orthographic right side view of the paintball pocket of FIG. 1.
Figure 4:
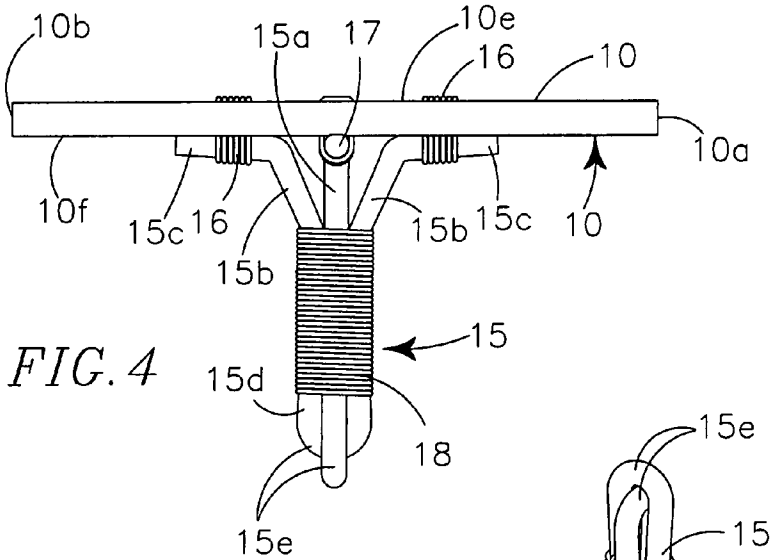
FIG. 4 is an orthographic top view of the paintball pocket of FIG. 1.

A rearwardly extending pocket handle 15, formed from a vertical loop 15*a* and a horizontal loop 15*b*, is fastened with stitching 16 to the back face 10*f* of the pocket strap 10. (FIG. 3) Each loop 15*a*, 15*b* is formed of cord-like material having some retentive memory, and each loop 15*a*, 15*b* has two opposing strap connecting ends 15*c* and a gripping portion 15*d* that is formed by bending each loop 15*a*, 15*b* over upon itself at fold 15*e*. The strap connecting ends 15*c* of the vertical loop 15*a* flare outwardly toward the top edge 10*c* and bottom edge 10*d* and are stitched 16 to the back face 10*f* of the pocket strap 10 adjacent the bases (not shown) of the vertically opposed triangular flaps 14. The strap connecting end 15*c* of the vertical loop 15*a* adjacent the top edge 10*c* of the pocket strap 10 extends beyond the top edge 10*c* forming a sighting nub 17 that is used by the operator to aim the sling shot. (FIGS. 2, 3, and 5).

The strap connecting ends 15*c* of the horizontal loop 15*b* flare outwardly toward the first and second elongate end portions 10*a*, 10*b* and are stitched 16 to the back face 10*f* of the pocket strap 10 adjacent the bases (not shown) of the horizontally opposed triangular flaps 14. The position of the stitching 16 relative to the triangular flaps 14 is critical because it influences the position of the fold line (not shown) whereat each triangular flap 14 bends rearwardly when a paintball 40 is placed in the paintball cavity 30.

Figure 6:
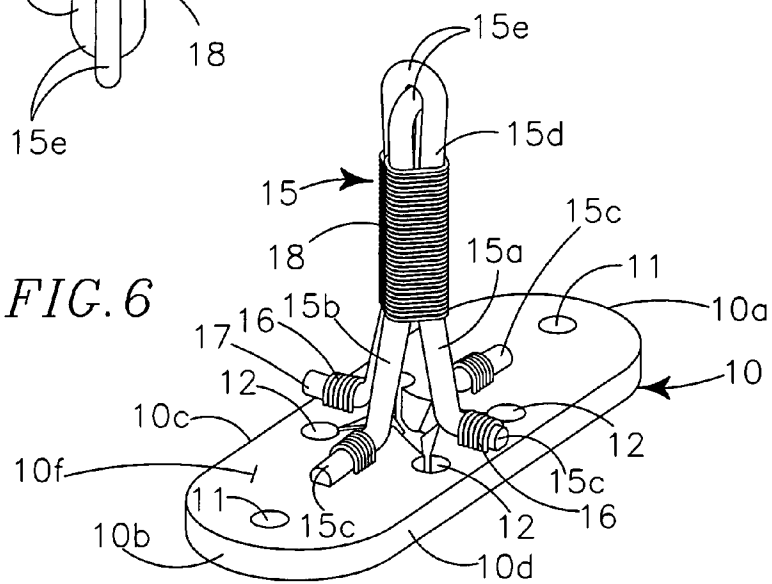
FIG. 6 is an isometric back and bottom view of the paintball pocket of FIG. 1 shown in an inverted position.
Figure 8:
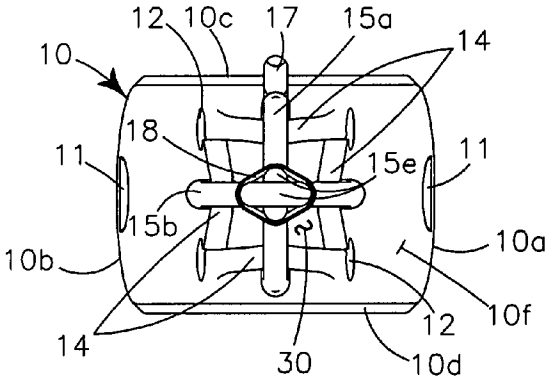
FIG. 8 is an enlarged orthographic back view of the paintball pocket of FIG. 7, less the elastomeric straps and less the slingshot.

The vertical loop 15*a* and the horizontal loop 15*b* extend rearwardly from the back face 10*f* of the pocket strap 10 in generally parallel alignment with each other and are circumferentially wrapped with thread 18 that secures the gripping portions 15*d* of the loops 15*a*, 15*b* together into the pocket handle 15. The thread 18 encircles the gripping portions 15*d* from a position spacedly forward the folds 15*e* and extends continuously forwardly to a position spacedly adjacent rearward the back face 10*f* of the pocket strap 10. In combination, the thread 18, the vertical loop 15*a* and the horizontal loop 15*b* create a four-sided funnel-like structure (FIGS. 1 and 6) that tapers inwardly rearwardly from the back face 10*f* of the pocket strap 10 to the forward most portion of the thread 18 encircling the loops 15*a*, 15*b*. The taper prevents a paintball 40 from moving too far rearwardly into the paintball cavity 30 because the diameter of the paintball 40 exceeds the diameter of the funnel-like structure defined by the vertical and horizontal loops 15*a*, 15*b*. This limitation is critical because if the paintball 40 moves too far rearwardly into the paintball cavity 30, it is possible the apex portions of the triangular flaps 14 may fold inwardly in front of the paintball 40 partially closing the paintball cavity 30 and preventing the paintball 40 from exiting the paintball cavity 30 when the sling shot 20 is fired.

Because the precise location where the rearward bend of the triangular flaps 14 will occur cannot be accurately predicted, the diameter of the paintball cavity 30 must range from slightly less than the diameter of the paintball 40 to slightly greater than the diameter of the paintball 40. To accommodate this required diametric variation, the center to center distance between the horizontally adjacent tear stop holes 12 and the center to center distance between the vertically adjacent tear stop holes 12 is approximately equal to the diameter of the paintball 40. Because of the equal spacing of the tear stop holes 12 and the surface texture of the pocket strap 10, when a paintball 40 is placed in the paintball cavity 30 there is minimal surface friction between the rearwardly folded triangular flaps 14 and the circumferential surface of the paintball 40. The friction that is present is generally concentrated at four equally spaced tangent points about the major circumference of the paintball 40. This friction is sufficient to positionally maintain the paintball 40 in the paintball cavity 30 without the operator needing to continuously hold the paintball 40 in place but is overcome when the slingshot 20 is fired.

Having described the structure of my paintball pocket for slingshots, its operation may be understood.

A releasable draw strap connector 27 having two spaced parallel legs (not shown) defining a medial slot (not shown) is positioned so that one leg of the draw strap connector 27 is inserted through the draw strap connecting hole 11 defined in each elongate end portion 10*a*, 10*b* of the pocket strap 10 and the second leg is adjacent laterally outward the elongate end portion 10*a*, 10*b* of the pocket strap 10.

The two legs (not shown) of the draw strap connector 27 are connected to an end portion of the elastomeric draw strap 25 opposite the slingshot arms 22, 23. In the preferred embodiment, the elastomeric draw straps 25 are sections of surgical tubing each defining a medial channel (not shown). The legs (not shown) of the draw strap connector 27 are inserted into the medial channel of the surgical tubing and are retained in place by radially extending ridges (not shown) defined in the draw strap connector 27 that engage with the circumferential surface of the medial channel. The above process is repeated for the opposing side of the pocket strap 10 and the second elastomeric draw strap 25. It is essential that the elastomeric straps 25 be of substantially equal lengths.

After the pocket strap 10 has been interconnected to both elastomeric draw straps 25 a paintball 40 is placed against the front face 10*e* of the pocket strap 10 at the intersection of the two through cuts 13. The operator applies gentle pressure on the paintball 40, forcing the triangular flaps 14 to bend rearwardly along a fold line (not shown) between the immediately adjacent tear stop holes 12. As the triangular flaps 14 bend rearwardly, the paintball moves rearwardly into the paintball cavity 30 defined by the four triangular flaps 14 and by the pocket handle 40 forward of the thread 18. The paintball 40 is positionally maintained in the paintball cavity 30 by friction between the rearwardly folded triangular flaps 14 and the circumferential surface of the paintball 15.

To fire the paintball 40, the slingshot handle 21 is held in one hand while the pocket handle 15 is grasped in the operator's other hand. The pocket handle 15 and the pocket strap 10 carrying the paintball 40 in the paintball cavity 30 is drawn rearwardly. The operator targets the paintball using the sighting nub 17 and releases grasp of the pocket handle 15. The contracting elastomeric straps 25 accelerate the pocket strap 10 and the paintball 40 forwardly through the space defined between the first and second slingshot arms 22, 23. The inertia generated by the contracting elastomeric straps 25 is transferred to the paintball 40. When the pocket strap 10 reaches its forward limit, which is determined by the length of the elastomeric straps 25, the paintball 40 is released from the paintball cavity 30 and the paintball 40 continues on a trajectory toward the target. To fire the slingshot again, the process of loading a paintball 40 into the paintball cavity 30 and drawing the pocket strap 10 is repeated as described above.

The foregoing description of my invention is necessarily of a detailed nature so that a specific embodiment of its best mode may be set forth as is required, but it is to be understood that various modifications of details, and rearrangement, substitution and multiplication of parts may be resorted to without departing from its spirit, essence or scope.

Having thusly described my invention, what I desire to protect by Letters Patent, and

What we claim is:

1. A paintball holding pocket for a slingshot having a handle with spaced upwardly and outwardly extending arms and elastomeric draw straps interconnecting the pocket and the arms, the pocket comprising in combination:

a flexible pocket strap having a first elongate end portion, an opposing second elongate end portion, a top edge, a bottom edge, a front face, a back face and defining a draw strap fastening hole in each elongate end portion to operatively interconnect with one elastomeric draw strap;

a paintball cavity defined in a medial portion of the pocket strap by four rectilinear arrayed tear stop holes and two intersecting through cuts, each through cut extending angularly between one upper tear stop hole and one laterally opposing lower tear stop hole forming two horizontally opposed triangular flaps and two vertically opposed triangular flaps, the paintball cavity having a diameter that positionally maintains a spherical paintball within the paintball cavity with friction between the triangular flaps and the circumferential surface of the paintball and readily releases the paintball from the paintball cavity when the sling shot is fired; and a pocket handle fastened to the back face of the pocket strap, the pocket handle having a horizontal loop with a gripping portion and two opposed strap connecting ends, each strap connecting end fastened to the back face of the pocket strap adjacent a horizontally opposed triangular flap, and a vertical loop having a gripping portion and two opposed strap connecting ends, each strap connecting end fastened to the back face of the pocket strap adjacent a vertically opposed triangular flap, the gripping portions of the horizontal loop and the vertical loop wrapped circumferentially with thread forming the pocket handle adjacent rearward the paintball cavity.

2. The paintball pocket for a sling shot of claim 1 wherein the pocket strap is suede leather.

3. The paintball pocket for a sling shot of claim 2 wherein the front face of the suede leather paintball pocket is unfinished having a rough texture.

4. The paintball pocket for a sling shot of claim 1 wherein the pocket handle defines a tapered funnel structure between the vertical loop and the horizontal loop that limits rearward movement of the paintball, and communicates with the paintball cavity.

5. The paintball pocket for a sling shot of claim 1 wherein each tear stop hole defined in the pocket strap is spaced from the immediately adjacent tear stop holes a distance substantially equal to the diameter of the paintball.

6. A paintball holding pocket for a slingshot having a handle with spaced upwardly and outwardly extending arms and elastomeric draw straps interconnecting the pocket and the arms, the pocket comprising in combination:

a flexible suede leather pocket strap having a first elongate end portion, an opposing second elongate end portion, a top edge, a bottom edge, an unfinished and roughly textured front face, a back face and defining a draw strap fastening hole in each elongate end portion to operatively interconnect with an each elastomeric draw strap;

a paintball cavity defined in a medial portion of the pocket strap by four spaced rectilinear arrayed tear stop holes and two intersecting through cuts, each through cut extending angularly between one upper tear stop hole and one laterally opposing lower tear stop hole forming two horizontally opposed triangular flaps and two vertically opposed triangular flaps, each tear stop hole spaced from the immediately adjacent tear stop holes a distance approximately equal to the diameter of a paintball, the paintball cavity having a diameter that positionally maintains the paintball within the paintball cavity with friction between the triangular flaps and the circumferential surface of the paintball and readily releases the paintball from the paintball cavity when the sling shot is fired; and a pocket handle fastened to the back face of the pocket strap, the pocket handle having, a horizontal loop with a gripping portion and two opposed strap connecting ends, each horizontal loop strap connecting end fastened to the back face of the pocket strap adjacent a horizontally opposed triangular flap, a vertical loop having a gripping portion and two opposed strap connecting ends, each vertical loop strap connecting end fastened to the back face of the pocket strap adjacent a vertically opposed triangular flap, thread circumferentially wrapping the gripping portions of the horizontal loop and the vertical loop forming a tapered funnel structure between the vertical loop and the horizontal loop that communicates with the paintball cavity and limits rearward movement of the paintball into the paintball cavity.

* * * * *